US010272350B2

(12) United States Patent
Lv et al.

(10) Patent No.: US 10,272,350 B2
(45) Date of Patent: Apr. 30, 2019

(54) PULSATING IMITATION SPEAKER

(71) Applicant: Dynacraft BSC, Inc., American Canyon, CA (US)

(72) Inventors: Huimin Lv, Foshan (CN); Bill Talios, Petaluma, CA (US); David Castrucci, Napa, CA (US); John Bisges, Buford, GA (US)

(73) Assignee: Dynacraft BSC, Inc., Buford, GA (US)

( * ) Notice: Subject to any disclaimer, the term of this patent is extended or adjusted under 35 U.S.C. 154(b) by 0 days.

(21) Appl. No.: 15/567,319

(22) PCT Filed: Jun. 14, 2017

(86) PCT No.: PCT/CN2017/088295
§ 371 (c)(1),
(2) Date: Oct. 17, 2017

(87) PCT Pub. No.: WO2018/227439
PCT Pub. Date: Dec. 20, 2018

(65) Prior Publication Data
US 2018/0361265 A1 Dec. 20, 2018

(51) Int. Cl.
*A63H 17/32* (2006.01)
*A63H 17/26* (2006.01)
(Continued)

(52) U.S. Cl.
CPC ..... *A63H 17/32* (2013.01); *A63H 17/262* (2013.01); *A63H 17/28* (2013.01); *A63H 17/34* (2013.01);
(Continued)

(58) Field of Classification Search
CPC ..... A63H 17/262; A63H 29/22; A63H 17/38; A63H 17/28; A63H 17/34; A63H 33/30; H04R 29/00; H04R 1/028
(Continued)

(56) References Cited

U.S. PATENT DOCUMENTS 2,821,191 A 1/1958 Paii
4,565,538 A * 1/1986 Kennedy ..... A63H 31/00 446/427
(Continued)

FOREIGN PATENT DOCUMENTS

CN 2242715 Y 12/1996
CN 2485013 Y 4/2002
(Continued)

OTHER PUBLICATIONS

International Search Report and Written Opinion for Application No. PCT/CN2017/088295 dated Jan. 25, 2018 (8 pages).

*Primary Examiner* — Vishu K Mendiratta
(74) *Attorney, Agent, or Firm* — Michael Best & Friedrich LLP

(57) ABSTRACT

A pulsating imitation speaker includes a fixed cover, a flexible cover, and a motor and gear assembly having a motor with a motor shah, a first gear on a first axle, and a second gear on a second axle. The motor is drivingly engaged with the first gear via a pinion on the motor shaft and the first gear is drivingly engaged with the second gear such that when the pinion is rotated by the motor, the first and second gear also rotate. The pulsating imitation speaker further includes an actuator fixedly engaged with the flexible cover and a first and second circular member each engaged with the actuator and respectively positioned on opposite ends of the second axle such that the circular members rotate with the second gear. The actuator is reciprocated by rotation of the circular members such that the flexible cover moves relative to the fixed cover, when the motor is activated.

15 Claims, 7 Drawing Sheets

(51) Int. Cl.

| | |
|---|---|
| ***A63H 17/28*** | (2006.01) |
| ***A63H 17/38*** | (2006.01) |
| ***A63H 29/22*** | (2006.01) |
| ***H04R 1/02*** | (2006.01) |
| ***H04R 29/00*** | (2006.01) |
| ***A63H 33/30*** | (2006.01) |
| ***A63H 17/34*** | (2006.01) |

(52) U.S. Cl.
CPC ..... *A63H 17/38* (2013.01); *A63H 29/22* (2013.01); *A63H 33/30* (2013.01); *H04R 1/028* (2013.01); *H04R 29/00* (2013.01)

(58) Field of Classification Search
USPC ..... 446/175, 189, 190, 191, 194, 195, 198, 446/199, 205
See application file for complete search history.

(56) References Cited

U.S. PATENT DOCUMENTS

| | | | | |
|---|---|---|---|---|
| 4,764,147 | A | 8/1988 | Baker et al. | |
| 5,074,820 | A | 12/1991 | Nakayama | |
| 5,401,201 | A | 3/1995 | Muraki | |
| 5,495,151 | A | 2/1996 | Lu | |
| 6,033,285 | A | 3/2000 | Fine et al. | |
| 6,039,626 | A * | 3/2000 | Gerold | A63H 17/262 446/175 |
| 6,106,362 | A * | 8/2000 | Keller | A63H 17/26 446/456 |
| 6,171,168 | B1 | 1/2001 | Jessop | |
| 6,652,353 | B1 | 11/2003 | Lund et al. | |
| 6,699,098 | B1 | 3/2004 | Kau | |
| 6,758,718 | B1 * | 7/2004 | Morris | A63H 17/28 446/431 |
| 8,210,894 | B2 | 7/2012 | Chan | |
| 2007/0060020 | A1 | 3/2007 | Civettini et al. | |
| 2008/0132143 | A1 | 6/2008 | Miyaura | |
| 2009/0030808 | A1 | 1/2009 | Park | |
| 2009/0156088 | A1 | 6/2009 | Mukaida | |
| 2009/0156089 | A1 | 6/2009 | Hoard et al. | |
| 2013/0005214 | A1 | 1/2013 | Davies | |
| 2013/0309935 | A1 | 11/2013 | Olson | |
| 2015/0049873 | A1 | 2/2015 | Buller | |

FOREIGN PATENT DOCUMENTS

| | | |
|---|---|---|
| CN | 201270538 Y | 7/2009 |
| CN | 203291503 U | 11/2013 |

* cited by examiner

PULSATING IMITATION SPEAKER

BACKGROUND

The present invention relates to a pulsating imitation speaker. Speakers that generate sound are known. The pulsating imitation speaker described herein looks like a speaker but does not generate sound. Instead, it noticeably moves up and down, or pulsates, without transmitting sound other than sound produced by the mechanical movement of it components. The pulsating imitation speaker can be used near a real speaker generating sound such as music. This movement of the pulsating imitation speaker heightens the sound experience for the person controlling the speaker and imitation speaker, as well as those around the person. When the pulsating speaker is in a ride-on toy vehicle, as in the example described here, the experience of riding the vehicle is greatly improved for the driver and those near the driver.

BRIEF SUMMARY OF THE INVENTION

In one embodiment, the invention provides a pulsating imitation speaker including a fixed cover, a flexible cover, and a motor and gear assembly having a motor with a motor shaft, a first gear on a first axle, and a second gear on a second axle. The motor is drivingly engaged with the first gear via a pinion on the motor shaft and the first gear is drivingly engaged with the second gear such that when the pinion is rotated by the motor, the first and second gear also rotate. The pulsating imitation speaker further includes an actuator fixedly engaged with the flexible cover and a first and second circular member each engaged with the actuator and respectively positioned on opposite ends of the second axle such that the circular members rotate with the second gear. The actuator is reciprocated by rotation of the circular members such that the flexible cover moves relative to the fixed cover, when the motor is activated.

In another embodiment, the invention provides a pulsating imitation speaker including a fixed cover, a flexible cover, a motor and gear assembly including a motor, and an actuator fixedly engaged with the flexible cover and drivingly engaged with the motor. The actuator is reciprocated by activation of the motor such that the flexible cover moves relative to the fixed cover.

In yet another embodiment, the invention provides a pulsating imitation speaker including a fixed cover, a flexible cover, a motor and gear assembly having a motor with a motor shaft, a face gear on a first axle, a first gear on the first axle, and a second gear on a second axle. The motor is drivingly engaged with the face gear via a pinion on the motor shaft. The first gear rotates concurrently with the face gear. The first gear is drivingly engaged with the second gear such that when the pinion is rotated by the motor, the face gear, the first gear, and the second gear also rotate. The pulsating imitation speaker further includes an eccentric mechanism having an actuator fixedly engaged with the flexible cover, circular members positioned on opposite ends of the second axle such that the circular members rotate with the second gear, a pair of levers extending between the bar and respective pins of the circular members. The pins are eccentrically positioned on the respective circular members, relative to a center of the circular member. The actuator is reciprocated by rotation of the circular members such that the flexible cover moves relative to the fixed cover, when the motor is activated.

Other aspects of the invention will become apparent by consideration of the detailed description and accompanying drawings.

DETAILED DESCRIPTION AND BEST MODE OF IMPLEMENTATION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
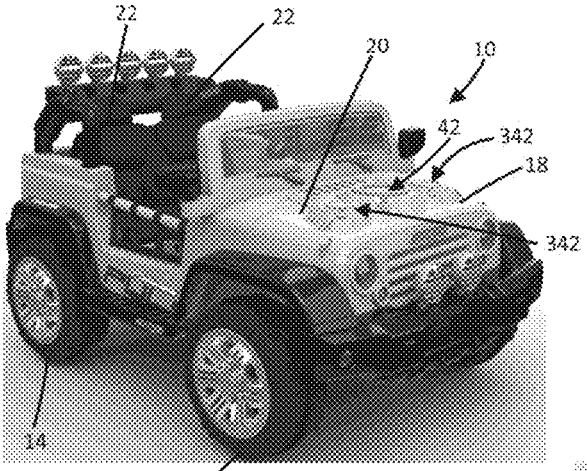
FIG. 1 shows a perspective view of a first embodiment of a rideable toy car including a plurality of pulsating imitation speakers.
Figure 2:
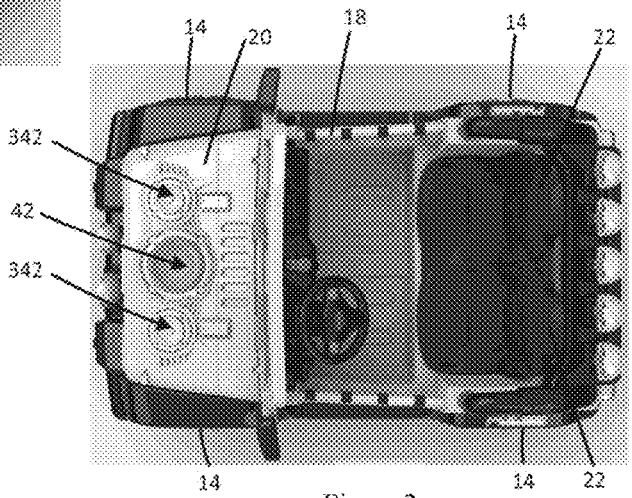
FIG. 2 shows a top view of the rideable toy car of FIG. 1.
Figure 3:
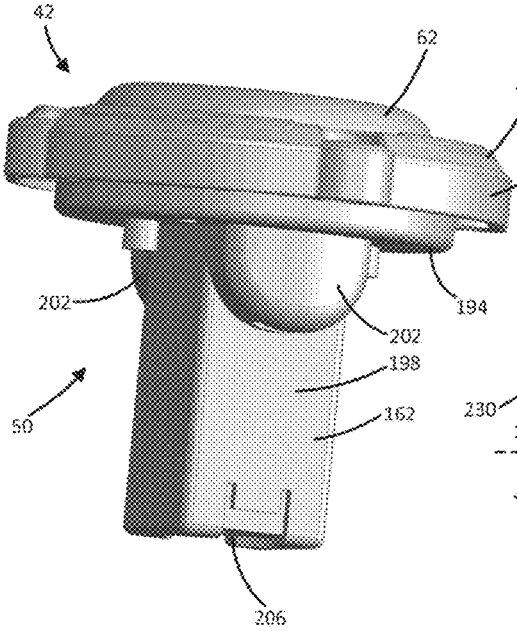
FIG. 3 shows a perspective view of a first embodiment of the pulsating imitation speakers of the rideable toy car of FIG. 1.

FIGS. 1 and 2 illustrate a first embodiment of a rideable toy car 10 that includes a plurality of wheels 14, a body 18 having two seats 22, a battery 26, a speaker 30 (illustrated in FIG. 11), an electronic controller 34 (illustrated in FIG. 11), an LED board 38 (illustrated in FIG. 7) having LED light sources 238, and a plurality of pulsating imitation speakers 42 mounted in a hood 20 of the body 18.

Figure 4:
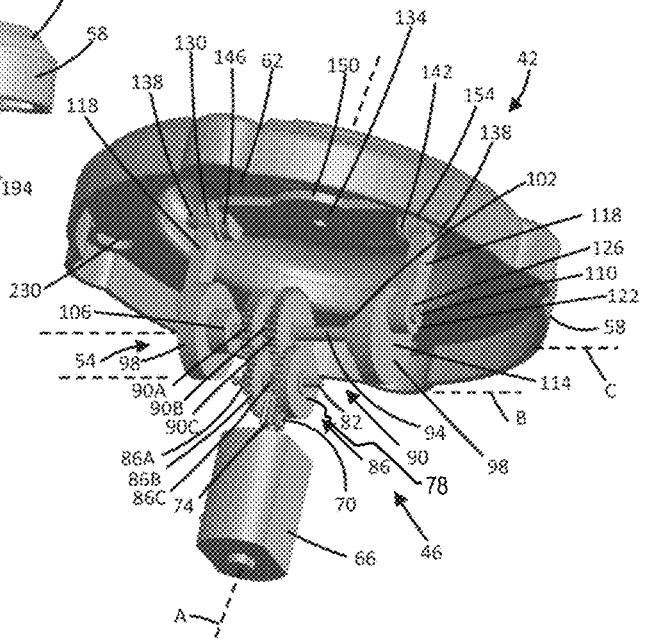
FIG. 4 shows a partial, perspective view of the pulsating imitation speaker of FIG. 3 with a housing removed.
Figure 5:
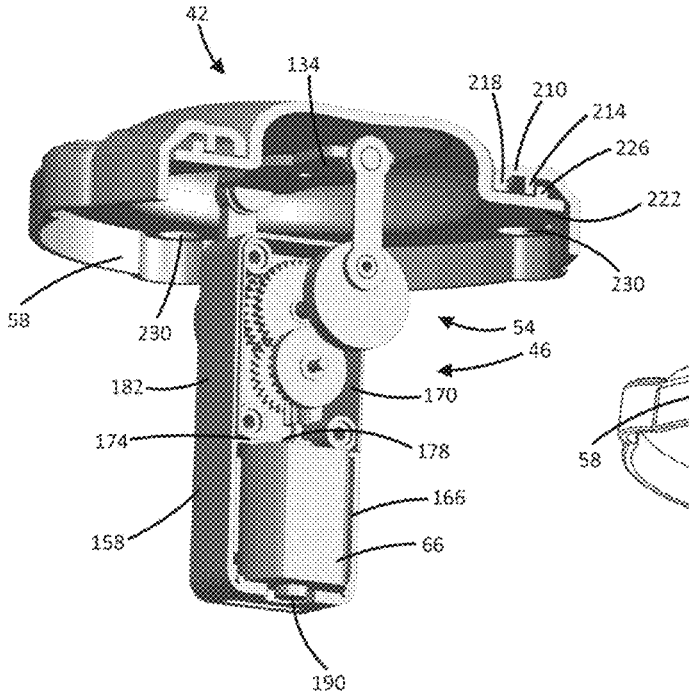
FIG. 5 shows a partial, sectioned, perspective view of the pulsating imitation speaker of FIG. 3.

FIGS. 3-6 illustrate a first embodiment of a pulsating imitation speaker 42 that includes the LED board 38 (illustrated in FIG. 7), a motor and gear assembly 46, a housing 50 that holds the motor and gear assembly 46 and the LED board 38, an eccentric mechanism 54 coupled to the motor and gear assembly 46, a fixed cover 58, and a flexible cover 62 which is reciprocated by the motor and gear assembly 46 via the eccentric mechanism 54, as explained in greater detail below. The pulsating imitation speaker 42 is an imitation speaker in that it does not produce acoustic output (i,e, no audible sound beyond that resulting from the mechanical movements of the motor and gear assembly 46 and the flexible cover 62). Rather, the pulsating imitation speaker 42 is made to look like a speaker (i.e., a woofer in a housing) and provides a visual effect in the form of the reciprocating flexible cover 62, As illustrated in FIGS. 4 and 5, the motor and gear assembly 46 includes a motor 66 that has a pinion 70 on a motor shaft 74, which defines a motor shaft axis A that extends through the fixed and flexible covers 58, 62. The motor and gear assembly 46 also includes a face gear 78 that is drivingly engaged with the pinion 70 and that is fixed on a first axle 82, which defines a first axle axis B, a first set of spur gears 86 fixed to the first axle 82 such that they are each rotatably coupled with the face gear 78, and a second set of spur gears 90 that are drivingly engaged with the first set of spur gears 86 and that are fixed on a second axle 94, which defines a second axle axis C. In the illustrated embodiment of FIG. 4, the first set of spur gears 86 includes a large inner gear 86B surrounded by two small gears 86A, 86C, and the second set of spur gears 90 includes a small inner gear 90B surrounded by two large gears 90A, 90C. In other embodiments, this arrangement may be flipped such that the first set of spur gears 86 includes a small inner gear surrounded by two large gears and the second set of spur gears 90 includes a large inner gear surrounded by two small gears. In yet other embodiments, the first and second sets of spur gears 86, 90 may each include only one spur gear coupled to one another.

As further illustrated in FIGS. 4 and 5, the first set of spur gears 86 is coupled to the second set of spur gears 90 such that the teeth of the inner gears 86B, 90B mesh and the teeth of the respective outer gears 86A, 86C, 90A, 90C mesh such that the second axle 94 rotates with the first axle 82. The large gears 86B, 90A, 90C and the small gears 86A, 86C, 90B of each gear set 86, 90 include the same outside circle diameter to provide the same gear speed ratio. The plurality of gears in the first and second sets of spur gears 86, 90 in the illustrated embodiment provides a secure and stable coupling between the first axle 82 and the second axle 94. Because the large inner gear 86B of the first set of spur gears 86 is between the two large gears 90A, 90C of the second set of spur gears 90 in the assembled state, the first set of spur gears 86 and the second set of spur gears 90 cannot substantially slip in a direction parallel to the first and second axle axes B, C, which otherwise could occur when driving the toy car 10. There is some space provided between the three large gears 86B, 90A, 90C such that they do not substantially rub against or interfere with one another in operation. When the motor 66 is activated, the pinion 70 rotates about the motor shall axis A. The first axle 82 and the second axle 94 begin rotating about the first axle axis B and the second axle axis C, respectively, which are both perpendicular to the motor shaft axis A, due to the rotational engagement between the pinion 70, the face gear 78, the first set of spur gears 86, and the second set of spur gears 90. The first axle and the second axle axes A, B are parallel to one another.

As further illustrated by FIGS. 4 and 5, the eccentric mechanism 54 includes two circular members 98 that are fixed at respective, opposite ends 102, 106 of the second axle 94. The circular members 98 each include a pin 110 fixed thereto that is positioned off-center relative to the rotational axis of the circular member 98 (i.e., the second axle axis C) such that when the circular member 98 is rotating with the second axle 94, the pin 110 is synchronously driven in a circular motion. In the illustrated embodiment of FIGS. 4 and 5, the pins 110 extend from external faces 114 of the circular members 98. Two levers 118 are respectively rotationally coupled to one of the circular members 98 via the pin 110 at a first end 122 of the respective lever 118. The first end 122 of each lever 118 includes an opening 126 through which the pin 110 extends. A second end 130 of the lever 118, which is opposite the first end 122 of the lever 118, is rotationally coupled to an actuator, such as a bar 134, that extends substantially parallel to the first and second axle axes B, C. The bar 134 includes two extensions 138 positioned at opposite axial ends 142, 146 of the bar 134. The bar 134 also includes a main body 150 that is fixedly coupled to the flexible cover 62, as explained in greater detail below. Each extension 138 extends through an opening 154 in the second end 130 of a respective lever 118 such that the bar 134 is rotationally coupled to the two circular members 98 via the two levers 118.

Figure 6:
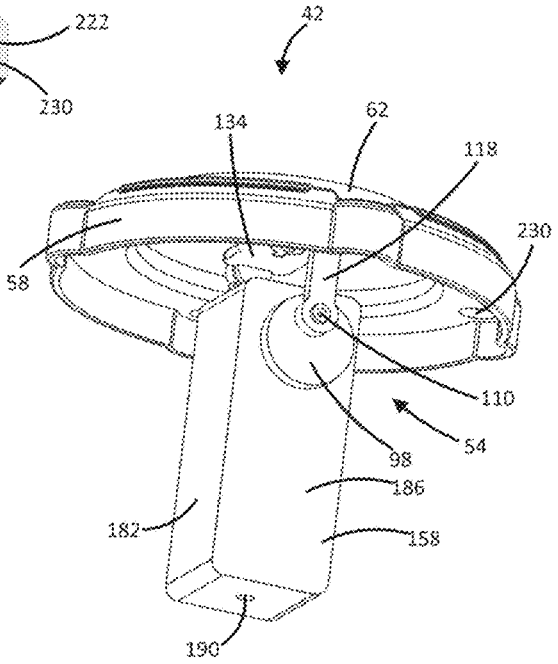
FIG. 6 shows a partial, perspective view of the pulsating imitation speaker of FIG. 3 with an outer shell part of a housing removed.

As illustrated by FIGS. 3-6, the housing 50 includes a first shell 158 and a second shell 162, which surrounds the first shell 158. The first shell 158 includes a first compartment 166, which houses the motor 66, and a second compartment 170, which houses the remainder of the motor and gear assembly 46. The first and second compartments 166, 170 are separated by a wall 174 that includes a hole 178 for the motor shaft 74 to extend therethrough. The first shell 158 includes a main body 182 and a cover 186, which couples to the main body 182. An Opening 190 is provided in the main body 182 so the motor 66 may be electrically coupled to the battery 26. The first shell 158 includes holes (not shown) for the second axle 94 to extend therethrough. As illustrated in FIG. 6, the circular members 98 are positioned outside of the first shell 158. The second shell 162 is generally shaped to house the first shell 158 and the eccentric mechanism 54. The second shell 162 includes an outer rim 194 coupled to the fixed and flexible covers 58, 62, as explained in greater detail below, a first portion 198 that houses the first shell 158, and two fender portions 202 for accommodating the eccentric mechanism 54, which is wider than the motor and gear assembly 46. The second shell 162 also includes an opening 206 that communicates with the opening 190 of the main body 182 so the motor 66 may be electrically coupled to the battery 26. The motor 66 operates the pulsating imitation speaker 42, as explained in greater detail below.

As illustrated in FIG. 5, the fixed cover 58 includes a rim 210 that couples to the flexible cover 62. The rim 210 includes an inner and an outer flange 214, 218 that perpendicularly extend from the rim 210. The flexible cover 62 includes an extended edge 222 that overlaps the rim 210 of the fixed cover 58. The flexible cover 62 further includes an axial lip 226 that perpendicularly extends from the extended edge 222 toward rim 210 such that the inner flange 214 of the rim 210 and the axial lip 226 may abut one another. The inner flange 214 of the rim 210 helps prevent the perimeter of the flexible cover 62 from sliding toward the bar 134 during operation of the pulsating imitation speaker 42, as explained in greater detail below.

As illustrated in FIGS. 2 and 4, the fixed and flexible covers 58, 62 each provide a number of holes 230 for fixedly coupling the pulsating imitation speaker 42 to the body 18 of the toy car 10. The four holes 230 of the covers 58, 62 are evenly spaced about the respective outer circumferences of the fixed and flexible covers 58, 62. In other embodiments, any number of holes 230 may be provided for functionally coupling the pulsating imitation speaker 42 to the body 18 of the toy car 10. Although not shown in the first embodiment, the outer rim 194 of the second shell 162 also includes four holes for coupling the pulsating imitation speaker 42 to the body 18 of toy car 10 (see FIG. 7, which shows the four holes, labeled as 534).

Figure 7:
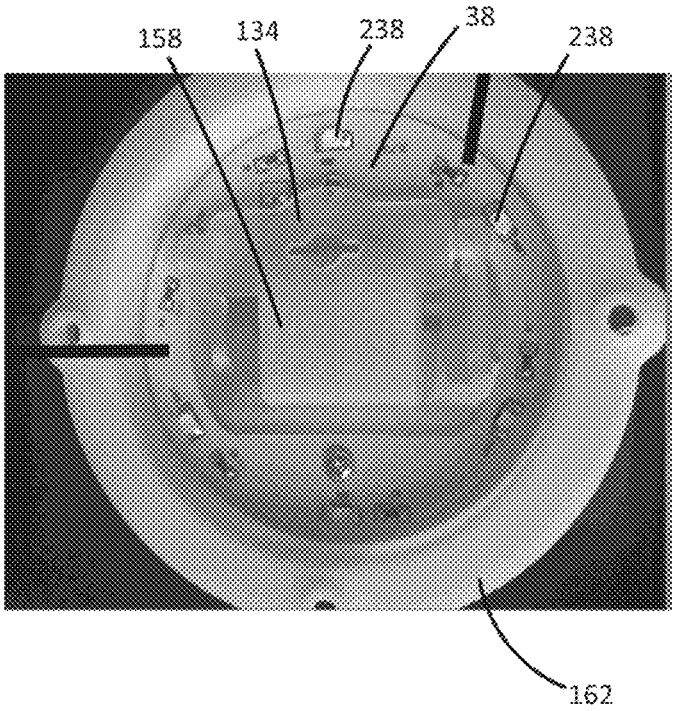
FIG. 7 shows a partial, top view of the pulsating imitation speaker of FIG. 3 with a part of the housing removed.

In some embodiments, the fixed and flexible covers 58, 62 may be at least partially transparent to show flashing LEDs 238 of the LED board 38. As illustrated in FIG. 7, the LED board 38 is positioned between and adjacent to the fixed and flexible covers 58, 62 and the second shell 162 of the housing 50 so that when the fixed and flexible covers 58, 62 and the second shell 162 are fixed to each other, the LED board 38 is held in place. The LED hoard 38 is generally ring shaped such that it fits around the first portion 198 of the second shell 162 and may be supported on the outer rim 194.

Figure 8:
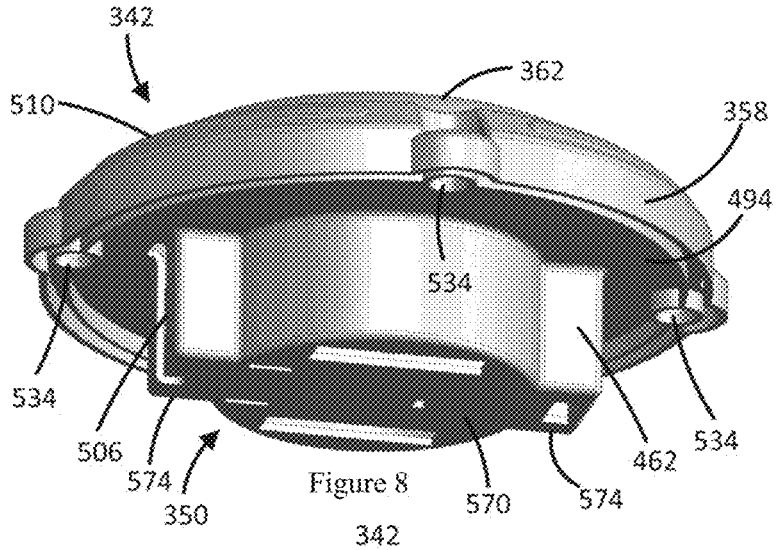
FIG. 8 shows a perspective view of a second embodiment of the pulsating imitation speakers of the rideable toy car of FIG. 1.
Figure 9:
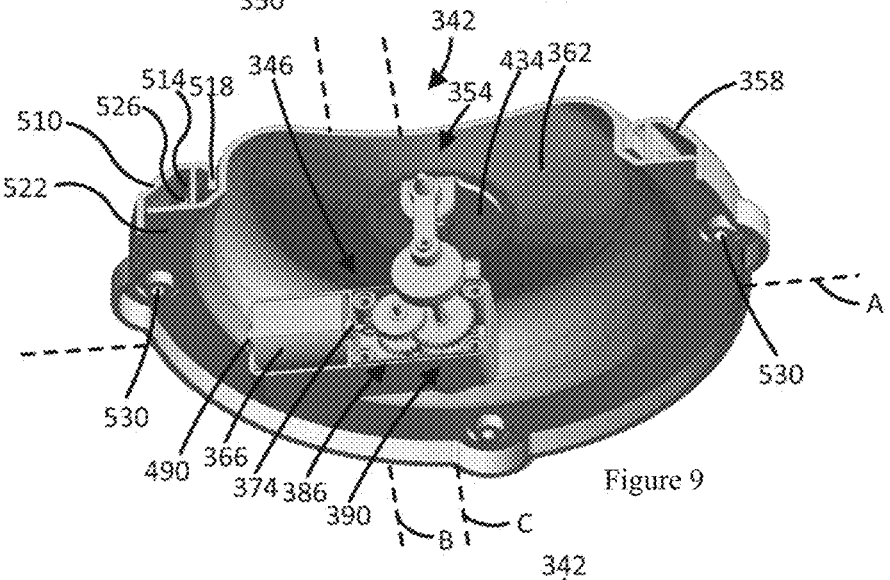
FIG. 9 shows a partial, sectioned, perspective view of the pulsating imitation speaker of FIG. 8.
Figure 10:
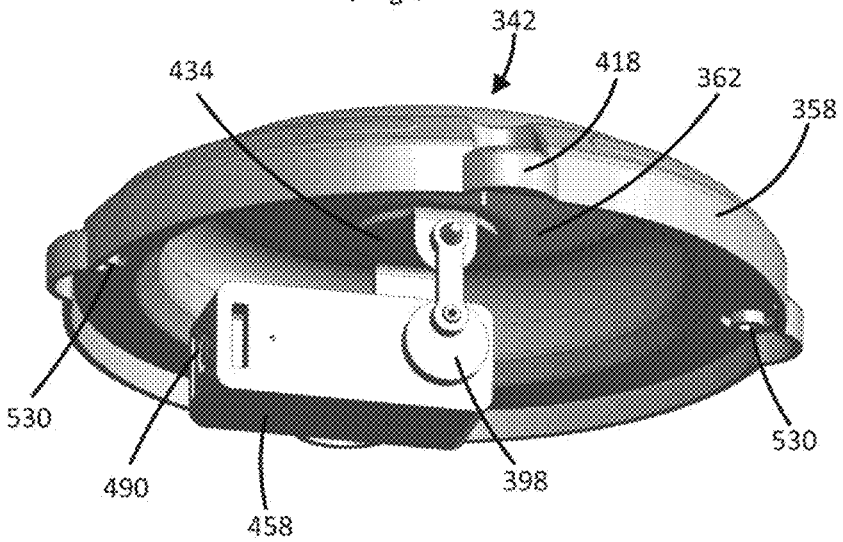
FIG. 10 shows a partial, perspective view of the pulsating imitation speaker of FIG. 8 with an outer shell part of a housing removed.

FIGS. 8-10 illustrate a second embodiment of the pulsating imitation speaker 342. The second embodiment of the pulsating imitation speaker 342 is substantially similar to the first embodiment of the pulsating imitation speaker 42 of FIGS. 3-6 such that only differences will be described herein. The elements of the second embodiment of the pulsating imitation speaker 342 that are similar to a respective element of the first embodiment are labeled as the same number plus 300.

Unlike the pulsating imitation speaker 42 of FIGS. 3-6, the pulsating imitation speaker 342 of FIGS. 8-10 has a motor shaft 374, included in the motor and gear assembly 346, having a motor axis A that does not extend through the fixed and flexible covers 358, 362. As illustrated by FIG. 9, the motor axis A extends substantially parallel to the bar 434 and is also substantially parallel to the top surface of the flexible cover 362. The housing 350 is accordingly modified to accommodate the motor and gear assembly 346. The first shell 458 is the same as the first shell 158 of the pulsating imitation speaker 42 of FIG. 3-6. The second shell 462 includes an outer rim 494 that is substantially similar to the outer rim 194 of the pulsating imitation speaker 42 of FIGS. 3-6 such that the outer rim 494 couples to the fixed and flexible covers 358, 362 in the same fashion. The second shell 462 farther includes a main body 570 and two extensions 574. The main body 570 is generally cylindrical to house the eccentric mechanism 354 and a majority of the first shell 458. The first shell 458 extends at least partially into one of the two extensions 574. The second shell 462 includes an opening 506 that communicates with the opening 490 of the main body 482 so the motor 366 may be electrically coupled to the battery 26. The opening 506 is in the extension 574 into which the first shell 458 partially extends.

Figure 11:
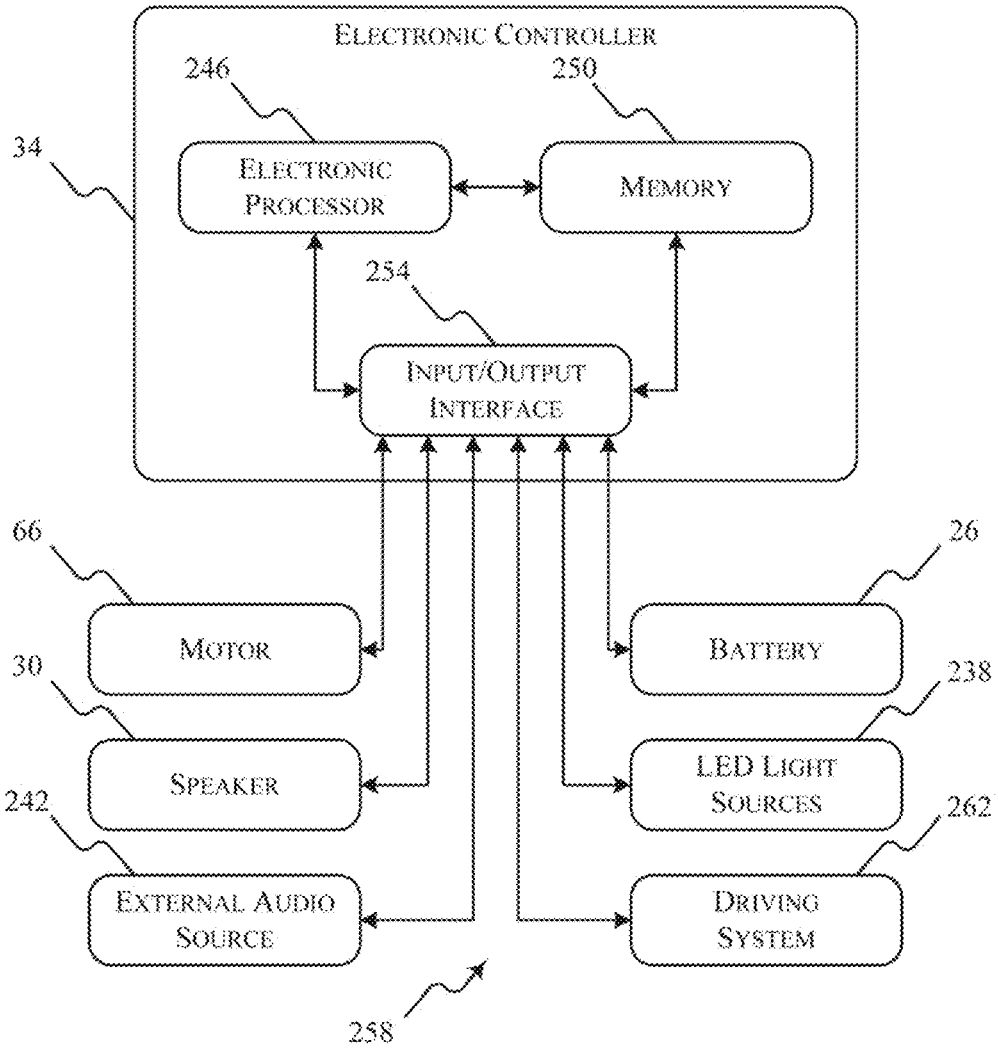
FIG. 11 shows a block diagram of control components included in the rideable toy car, in accordance with some embodiments.

FIG. 11 is diagram of one embodiment of control components included in the rideable toy car 10. The embodiment illustrated includes the electronic controller 34, the motor 66, the battery 26, the acoustically functioning speaker 30, the LED light sources 238, and an external audio data source 242. Although not illustrated, the speaker 30 may be positioned in almost any reasonable location in the rideable toy car 10. For example, the speaker 30 may be positioned adjacent the pulsating imitation speakers 42, 342 in the hood 20 of the rideable toy car 10. Alternatively, the speaker 30 may be positioned adjacent (e.g., behind or under) the seats 22. In some embodiments, the rideable toy car 10 includes multiple pulsating imitation speakers 42, 342 and therefore more than one motor 66 as each pulsating imitation speaker 42, 342 may include a separate motor for each of the pulsating imitation speakers 42, 342.

The electronic controller 34 includes, among other things, an electronic processor 246 (for example, a microprocessor or microcontroller), memory 250, an input/output interface 254, and one or more buses 258. The one or more buses 258 connect various components of the electronic controller 34 including the memory 250 to the electronic processor 246. The memory 250 includes read only memory (ROM), random access memory (RAM), an electrically erasable programmable read-only memory (EEPROM), other non-transitory computer-readable media, or any combination thereof. The electronic processor 246 is configured to retrieve program instructions and data from the memory 250 and execute, among other things, instructions to perform the methods described herein. Additionally or alternatively, the memory 250 is included in the electronic processor 246. The input/output interface 254 includes routines for transferring information between components within the electronic controller 34 and other components internal and external to the rideable toy car 10.

The battery 26 supplies a nominal DC voltage to the rideable toy car 10 (e.g., 6 Volts or 12 Volts). In some embodiments, the rideable toy car 10 includes more than one battery 26, or one or more battery packs. In some embodiments, the rideable toy car 10 includes electrical components configured to supply lower voltages to operate circuits and components within rideable toy car 10. The speaker 30 is operably coupled to the electronic controller 34 to receive an analog electrical audio signal therefrom. The analog electrical audio signal from the electronic controller 34 causes the speaker 30 to produce acoustic output (i.e., audible sound). The electronic controller 34 generates the analogelectrical audio signal based on audio data. In some embodiments, the audio data is included in an external electrical audio signal received from the external audio data source 242. The external electrical audio signal can include an analog signal, a digital signal, or both. The external audio data source 242 includes any electronic device capable of providing an electrical audio signal (e.g., a mobile phone or an MP3 player). Alternatively or in addition, the audio data is stored in the memory 250. For example, the electronic processor 246 retrieves the audio data stored in the memory 250 and generates the analog electrical audio signal based on the audio data. In some embodiments, the electronic controller 34 alters the analog electrical audio signal prior to sending it to the speaker 30. For example, the electronic processor 246 filters and amplifies the analog electrical audio signal prior to sending it to the speaker 30.

The motor 66 operating the pulsating imitation speaker 42, 342 may be, for example, a DC electric motor (e.g., a permanent magnet DC motor or an electrically-excited DC motor). The motor 66 is electrically coupled to the electronic controller 34 to receive a continuous electrical power signal therefrom. The continuous electrical power signal from the electronic controller 34 causes the motor 66 to rotate. For example, the electrical current of the continuous electrical power signal flows through an armature (not illustrated) of the motor 66 producing a magnetic field between the armature and a stator (not illustrated) of the motor 66 which causes the armature to rotate. The motor 66 is stationary (i.e., not rotating) when the continuous electrical power signal is not received or when the electrical current of the continuous electrical power signal received is below a minimum current threshold. The rate of armature rotation varies based on the amount of electrical current of the continuous electrical power signal. In sonic embodiments, the rate of armature rotation depends at least in part on the voltage of the battery 26. For example, the rate of armature rotation can be 117 rotations per minute when the battery 26 is a 6 Volt battery, and the rate of armature rotation can be 96 rotations per minute when the battery 26 is a 12 Volt battery.

The electronic controller 34 generates the continuous electrical power signal for the motor 66 based in part on the audio data. In some embodiments, when the amplitude of the audio data is above a predetermined amplitude threshold, the electronic controller 34 sends a continuous electrical power signal having a constant electrical current to the motor 66 which causes the motor 66 to rotate at a constant speed. Alternatively or in addition, the electronic controller 34 sends a continuous electrical power signal with a varying electrical current to the motor 66 which causes the motor 66 to rotate at different speeds. In some embodiments, the electronic controller 34 sets the electrical current of the continuous electrical power signal based in part on the amplitude of the audio data. For example, the electronic controller 34 increases the electrical current of the continuous electrical power signal when the amplitude of the audio data increases, and decreases the electrical current of the continuous electrical power signal when the amplitude of the audio data decreases. In some embodiments, the electronic controller 34 sets the electrical current of the continuous electrical power signal based in part on the beat of the audio data. For example, the electronic controller 34 increases the electrical current of the continuous electrical power signal when the beat of the audio data is higher, and decreases the electrical current of the continuous electrical power signal when the beat of the audio data is lower.

The LED light sources 238 are positioned within the housing 50 of the pulsating imitation speaker 42 to illuminate the reciprocating flexible cover 62. The LED light sources 238 are electrically coupled to the electronic controller 34 to receive a pulsed electrical power signal therefrom. The pulsed electrical power signal from the electronic controller 34 causes the LED light sources 238 to emit visible light. The intensity of visible light emitted from the LED light sources 238 varies based in part on the duty-cycle of the pulsed electrical power signal. The LED light sources 238 do not emit visible light when the pulsed electrical power signal is not received or when duty-cycle of the pulsed electrical power signal is below a minimum duty-cycle threshold, The electronic controller 34 generates the pulsed electrical power signal for the LED light sources 238 based in part on the audio data. In some embodiments, when the amplitude of the audio data is above a predetermined amplitude threshold, the electronic controller 34 sends a pulsed electrical power signal having a constant duty-cycle to the LED light sources 238 which causes the LED light sources 238 to emit visible light having a constant intensity. In other embodiments, when the beat of the audio data is above a predetermined beat threshold, the electronic controller 34 sends a pulsed electrical power signal having a constant duty-cycle to the LED light sources 238 which causes the LED light sources 238 to emit visible light having a constant intensity.

Alternatively or in addition, the electronic controller 34 periodically sends a pulsed electrical power signal which causes the LED light sources 238 to emit periodic flashes of visible light. In some embodiments, the electronic controller 34 sets the period of light flashing based on the beat of the audio data. For example, the electronic controller 31 increases the period of light flashing when the beat of the audio data increases, and decreases the period of light flashing when the beat of the audio data decreases.

Alternatively or in addition, the electronic controller 34 sends a pulsed electrical power signal with a varying duty-cycle to the LED light sources 238 which causes the LED light sources 238 to emit visible light having a varying intensity. In some embodiments, the electronic controller 34 sets the duty of the pulsed electrical power signal based in part on the amplitude of the audio data. For example, the electronic controller 34 increases the duty-cycle of the pulsed electrical power signal when the amplitude of the audio data increases, and decreases the duty-cycle of the pulsed electrical power signal when the amplitude of the audio data decreases.

As explained above, the electronic controller 34 sends electrical power supplied from the battery 26 to the speaker 30, the LED light sources 238, and the motor 66 of the pulsating imitation speaker 42, 342. In some embodiments, the battery 26 also supplies electrical power to the wheels 14 so that an operator, who is riding in one of the seats of the toy car 10, may propel and steer the toy car 10. For example, the electronic controller 31 (or a separate controller) sends electrical power supplied by the battery 26 to a driving system 262 in the toy car 10.

Figure 12:
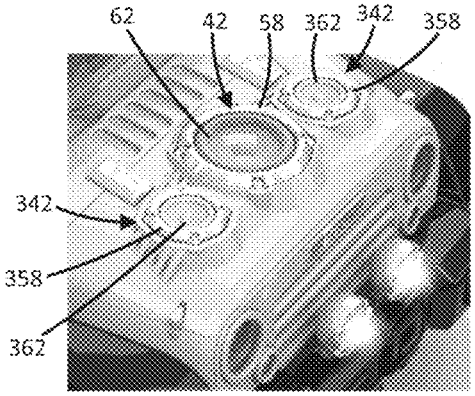
FIGS. 12-14 show the pulsating imitation speaker of FIG. 3 and the pulsating imitation speaker of FIG. 8 during operation.
Figure 13:
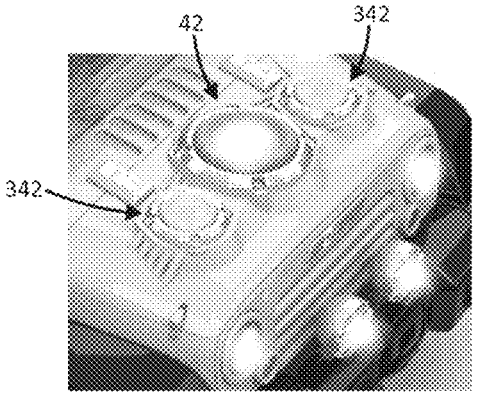
Figure 14:
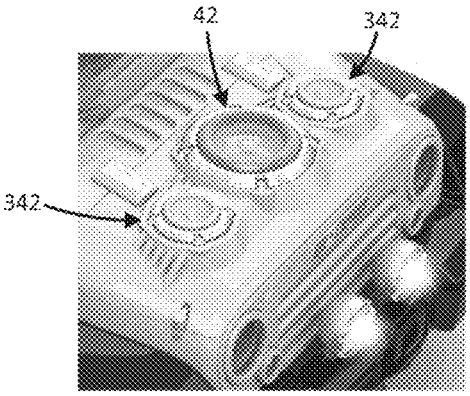

FIGS. 12-14 illustrate the first and the second embodiment of the pulsating imitation speakers 42, 342 installed in the hood 20 of the toy car 10 in operation. Specifically, FIGS. 12-14 illustrate one potential cycle of the pulsating imitation speakers 42, 342.

FIG. 12 illustrates a first position of the pulsating imitation speakers 42, 342 where the LED light sources 238 are not emitting visible light and the motor 66 is not rotating.

FIG. 13 illustrates a second position of the pulsating imitation speakers 42, 342 where the LED light sources 238 are emitting visible light and the motor 66 is rotating. As explained above, when the amplitude of the audio data is above a predetermined amplitude threshold, the electronic controller 34 sends a continuous electrical power signal to the motor 66 which causes the motor 66 to rotate. The rotation of the motor 66 causes the flexible cover 62 to reciprocate via the above-described motor and gear assembly 46 and eccentric mechanism 54. The electronic controller 34 concurrently sends a pulsed electrical power signal to the LED light sources 238 which causes the LED light sources 238 to emit visible light. The bar 134, although not shown in FIG. 12, is reciprocated to its highest position in FIG. 12 (i.e., the pins 110 are at the top of the circular members 98, as shown in FIG. 4). The LED light sources 238 and the motor 66 are synchronized such that LED light sources 238 emit visible light at the same time as when the bar 134 is rotated to its highest position, where the levers 118 are substantially perpendicular to the second axle 94. In other embodiments, the operation of the LED light sources 238 and the motor 66 are not synchronized. For example, the LED light sources 238 emit periodic flashes of visible light at a rate that is independent of the reciprocating rate of the bar 134, which may or may not be at the same rate as the beat of the audio data.

FIG. 14 illustrates a third position of the pulsating imitation speakers 42, 342 where the LED light sources 238 are not emitting visible light, but the motor 66 is rotating. As stated above, the LED light sources 238 emit strobes of visible light, but the motor 66 is continuously rotating when the external electrical audio signal is above the set threshold. Accordingly, the motor 66 will be rotating at times when the LED light sources 238 are not emitting visible light.

FIGS. 12-14 illustrate a cycle of the pulsating imitation speakers 42, 342 in which the bar 134 rotates to reciprocate the flexible cover 62 up and down relative to the fixed cover 58. In the illustrated embodiment, the LED light sources 238 emit visible light at the top of the cycle of the bar 134 and do not emit visible light when the bar 134 is not at the top of the cycle. When the amplitude of the audio data rises above the predetermined amplitude threshold, the motor 66 begins to rotate, causing the flexible cover 62 to reciprocate (i.e., proceed to FIG. 13 from FIG. 12). When the bar 134 is at the top of the cycle, the LED light sources 238 briefly emit visible light, while the motor 66 is continuously rotating. After the brief emission of visible light (i.e., proceed to FIG. 14 from FIG. 13), the bar 134 continues its reciprocation and the process is repeated (i.e., proceed to FIG. 12 from FIG. 14).

Thus, the invention provides, among other things, a pulsating imitation speaker. Various features and advantages of the invention are set forth in the following claims.

The invention claimed is:

1. A pulsating imitation speaker comprising:

a fixed cover configured to be mounted to a rideable toy car;

a flexible cover that is movably coupled to the fixed cover;

an actuator fixedly engaged with the flexible cover;

a first circular member engaged with the actuator;

a second circular member engaged with the actuator;

a gear assembly including a first gear on a first axle and a second gear on a second axle, the second gear being drivingly engaged with the first gear, the first and second circular members being positioned on opposite ends of the second axle such that the circular members rotate with the second gear; and a motor including a motor shaft and a pinion coupled to the motor shaft, the first gear being drivingly engaged with the pinion;

wherein the actuator is reciprocated by rotation of the circular members such that the flexible cover moves relative to the fixed cover, when the motor is activated, wherein the actuator is fixedly engaged to the circular members via a pair of levers and a pair of pins, wherein each of the first and second circular members includes one of the pair of pins, and wherein each of the pair of levers extend between the actuator and one of the pair of pins.

2. The pulsating imitation speaker according to claim 1, wherein the first gear is one of a first plurality of gears, all being on the first axle, and wherein the second gear is one of a second plurality of gears, all being on the second axle.

3. The pulsating imitation speaker according to claim 2, wherein each of the first plurality of gears is respectively engaged with one of the second plurality of gears.

4. The pulsating imitation speaker according to claim 1, wherein the pair of pins are eccentrically positioned on the respective circular member, relative to a center of the circular member.

5. The pulsating imitation speaker according to claim 1, wherein the motor and gear assembly further includes a face gear, wherein the face gear is positioned between the first gear and the pinion such that the pinion is drivingly engaged with the first gear via the face gear.

6. The pulsating imitation speaker according to claim 5, wherein the face gear is on the first axle.

7. The pulsating imitation speaker according to claim 1, wherein the flexible cover permits light to be visible there through, and wherein the pulsating imitation speaker further comprises an LED board including a plurality of LED light sources sufficiently close to the flexible cover to be visible through the flexible cover.

8. The pulsating imitation speaker according to claim 7, further comprising an electric controller coupled to the motor and configured to retrieve audio data, detect when an amplitude or a beat of the audio data is above a predetermined threshold, and generate an electrical power signal to activate the motor when the amplitude or the beat of the audio data is above the predetermined threshold.

9. A pulsating imitation speaker comprising:

a fixed cover configured to be mounted to a rideable toy car;

a flexible cover that is movably couple to the fixed cover;

an actuator fixedly engaged with the flexible cover;

a first circular member engaged with the actuator;

a second circular member engaged with the actuator;

a gear assembly including a first gear on a first axle and a second gear on a second axle, the second gear being drivingly engaged with the first gear, the first and second circular members being positioned on opposite ends of the second axle such that the circular members rotate with the second gear;

a motor including a motor shaft and a pinion coupled to the motor shaft, the first gear being drivingly engaged with the pinion;

an electronic controller coupled to the motor and configured to retrieve audio data, detect when an amplitude or a beat of the audio data is above a predetermined threshold, and generate an electrical power signal to activate the motor when the amplitude or the beat of the audio data is above the predetermined threshold, wherein the actuator is reciprocated by rotation of the circular members such that the flexible cover moves relative to the fixed cover, when the motor is activated.

10. A pulsating imitation speaker comprising:

a fixed cover configured to be mounted to a rideable toy car;

a flexible cover that is movably coupled to the fixed cover;

an actuator fixedly engaged with the flexible cover;

a gear assembly engaged with the actuator;

a motor drivingly engaged with the gear assembly; and an electronic controller coupled to the motor and configured to retrieve audio data, detect when an amplitude or a beat of the audio data is above a predetermined threshold, and generate an electrical power signal to activate the motor when the amplitude or the beat of the audio data is above the predetermined threshold, wherein the actuator is reciprocated by activation of the motor such that the flexible cover moves relative to the fixed cover.

11. The pulsating imitation speaker according to claim 10, wherein the flexible cover permits light to be visible there-through, and wherein the pulsating imitation speaker further comprises an LED board including a plurality of LED light sources sufficiently close to the flexible cover to be visible through the flexible cover.

12. A pulsating imitation speaker comprising:

a fixed cover configured to be mounted to a rideable toy car;

a flexible cover that is movably coupled to the fixed cover;

an eccentric mechanism including an actuator fixedly engaged with the flexible cover, circular members engaged with the actuator, each circular member having a pin, each of the pins being eccentrically positioned on the circular member relative to a center of the circular member, and, a pair of levers, one of the pair of levers extending between the actuator and the pin of the one of the circular members and the other of the pair of levers extending between the actuator and the pin of the other of the circular members, a gear assembly including a face gear on a first axle, a first gear on the first axle, the first gear being rotatable with the face gear, and a second gear on a second axle, the circular members being positioned on opposite ends of the second axle such that the circular members rotate with the second gear, and a motor including a motor shaft and a pinion coupled to the motor shaft, the motor being drivingly engaged with the face gear via the pinion, wherein the first gear rotates concurrently with the face gear, wherein the first gear is drivingly engaged with the second gear such that when the pinion is rotated by the motor, the second gear also rotates; and wherein the actuator is reciprocated by rotation of the circular members such that the flexible cover moves relative to the fixed cover, when the motor is activated.

13. The pulsating imitation speaker according to claim 12, further comprising an electronic controller coupled to the motor and configured to retrieve audio data, detect when an amplitude or a beat of the audio data is above a predetermined threshold, and generate an electrical power signal to activate the motor when the amplitude or the beat of the audio data is above the predetermined threshold.

14. The pulsating imitation speaker according to claim 12, wherein the flexible cover permits light to be visible therethrough, and wherein the pulsating imitation speaker further comprises an LED board including a plurality of LED light sources sufficiently close to the flexible cover to be visible through the flexible cover.

15. The pulsating imitation speaker according to claim 14, further comprising an electronic controller coupled to the motor and configured to retrieve audio data, detect when an amplitude or a beat of the audio data is above a predetermined threshold, and generate an electrical power signal to activate the motor when the amplitude or the beat of the audio data is above the predetermined threshold.

* * * * *